US008932093B2

(12) United States Patent
Hagi

(10) Patent No.: US 8,932,093 B2
(45) Date of Patent: Jan. 13, 2015

(54) OUTBOARD MOTOR

(71) Applicant: Yamaha Hatsudoki Kabushiki Kaisha, Iwata-shi, Shizuoka (JP)

(72) Inventor: Tomohiro Hagi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 195 days.

(21) Appl. No.: 13/788,131

(22) Filed: Mar. 7, 2013

(65) Prior Publication Data

US 2013/0316603 A1 Nov. 28, 2013

(30) Foreign Application Priority Data

May 23, 2012 (JP) ..... 2012-117407

(51) Int. Cl.
*B63H 20/02* (2006.01)
*B63H 20/08* (2006.01)
*B63H 21/30* (2006.01)

(52) U.S. Cl.
CPC ..... *B63H 20/02* (2013.01); *B63H 20/08* (2013.01); *B63H 21/305* (2013.01)
USPC ..... 440/53; 440/52

(58) Field of Classification Search
USPC ..... 440/52, 53; 248/640
See application file for complete search history.

(56) References Cited

U.S. PATENT DOCUMENTS

| | | | | | |
|---|---|---|---|---|---|
| 4,507,090 | A * | 3/1985 | Kobayashi et al. | ..... | 440/52 |
| 5,180,319 | A * | 1/1993 | Shiomi et al. | ..... | 440/52 |
| 5,503,576 | A * | 4/1996 | Ming et al. | ..... | 440/52 |
| 5,967,865 | A * | 10/1999 | Nakamura et al. | ..... | 440/52 |
| 6,341,991 | B1 * | 1/2002 | Ogino | ..... | 440/53 |
| 6,390,863 | B1 * | 5/2002 | Imanaga | ..... | 440/53 |
| 8,118,628 | B2 * | 2/2012 | Hagi | ..... | 440/52 |

FOREIGN PATENT DOCUMENTS

JP 2006-312379 A 11/2006

* cited by examiner

*Primary Examiner* — Lars A Olson
(74) *Attorney, Agent, or Firm* — Keating & Bennett, LLP

(57) ABSTRACT

In an outboard motor, a first damper member is disposed between a bracket and a casing such that the first damper member supports a weight of an outboard motor body. A second damper member is disposed between the bracket and the casing. The casing or the bracket includes a left first inclined surface and a right first inclined surface. The left first inclined surface and the right first inclined surface are inclined with respect to a front-back direction of the outboard motor body in a planar view of the outboard motor body. The second damper member includes a left second inclined surface and a right second inclined surface. The left second inclined surface is arranged to oppose the left first inclined surface. The right second inclined surface is arranged to oppose the right first inclined surface.

19 Claims, 11 Drawing Sheets

OUTBOARD MOTOR

BACKGROUND OF THE INVENTION

1. Field of the Invention

The present invention relates to an outboard motor.

2. Description of the Related Art

An outboard motor is provided with an outboard motor body and a steering axle. The steering axle is attached to a boat. A rudder angle of the outboard motor is changed by rotating the outboard motor body centered on the steering axle. That is, a propulsion direction of the boat is changed.

The outboard motor body is attached to the steering axle via a bracket. Specifically, a casing is provided in the outboard motor body and the bracket is attached to the casing via a damper member. For example, as disclosed in Japanese Laid-open Patent Application Publication No. 2006-312379. the damper member has a substantially cylindrical shape and extends in a front-back direction of the outboard motor body. The damper member attenuates vibration transmitted from the outboard motor body to the boat. In addition, the damper member receives a load in the front-back direction of the outboard motor due to the weight of the outboard motor body or a propulsion force which is generated by a propeller. In addition, a load is received in the left-right direction of the outboard motor in addition to the load in the front-back direction of the outboard motor due to the propulsion force when the outboard motor is being steered while moving.

In order to attenuate vibration which is transmitted from an engine to a boat, it is preferable that the damper member be flexible. However, there is a problem in that control stability of the outboard motor decreases as the flexibility of the damper member increases. That is, when a boat operator turns a rudder of the boat, a rudder angle of the outboard motor reaches a rudder angle which is a target angle at a timing which is delayed from that intended by the boat operator. As the delay time increases, the control stability decreases. When a turning operation of the outboard motor is carried out, the damper member receives a load in the left-right direction. At this time, since the amount of change in the shape of the damper member increases as the flexibility of the damper member increases, the delay time during steering increases. In particular, during high-speed movement, since the load increases in the left-right direction which is received by the outboard motor during steering, the decrease in the control stability of the outboard motor is particularly significant and problematic.

SUMMARY OF THE INVENTION

Preferred embodiments of the present invention provide an outboard motor which maintains a capacity to attenuate vibration which is transmitted from an outboard motor body to a boat during low-speed movement and is able to minimize a decrease in the control stability during high-speed movement.

An outboard motor according to a preferred embodiment of the present invention includes an outboard motor body, a bracket, a steering axle, a first damper member, and a second damper member. The outboard motor body includes an engine, an engine cover, a drive shaft, and a casing. The engine cover accommodates the engine. The drive shaft is disposed below the engine cover and transfers a motive force to a propeller. The casing accommodates the drive shaft. The bracket is attached to the casing. The steering axle is supported by the bracket. The first damper member is disposed between the bracket and the casing. The first damper member supports a weight of the outboard motor body. The second damper member is disposed between the bracket and the casing. The casing or the bracket includes a left first inclined surface and a right first inclined surface. The left first inclined surface and the right first inclined surface are inclined with respect to the front-back direction of the outboard motor body in a planar view of the outboard motor body. The second damper member includes a left second inclined surface and a right second inclined surface. The left second inclined surface is arranged to oppose the left first inclined surface. The right second inclined surface is arranged to oppose the right first inclined surface.

With the outboard motor according to a preferred embodiment of the present invention, the first damper member supports the weight of the outboard motor body. As a result, during low-speed movement, it is possible to effectively attenuate vibration which is transmitted from the engine to the boat using the first damper member. In addition, it is possible for the second damper member to receive a load in the left-right direction of the outboard motor body due to the left first inclined surface and the left second inclined surface coming into contact with each other or due the right first inclined surface and the right second inclined surface coming into contact with each other. As a result of this arrangement, it is possible to minimize a decrease in the control stability during high-speed movement.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
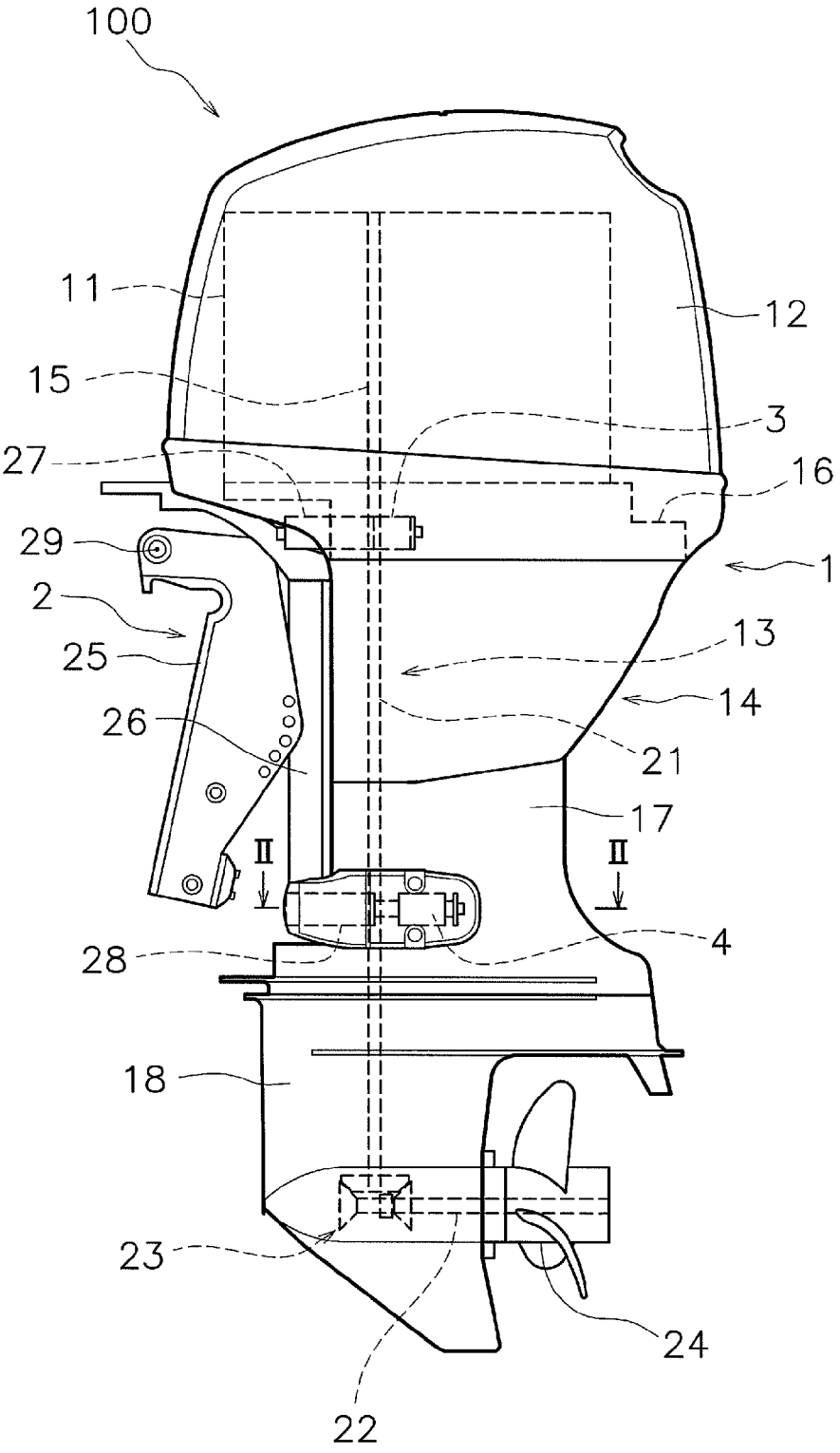
FIG. 1 is a side view diagram of an outboard motor according to a first preferred embodiment of the present invention.

Below, preferred embodiments of the present invention will be described with reference to the drawings. FIG. 1 is a side view diagram of an outboard motor 100 according to a first preferred embodiment of the present invention. The outboard motor 100 includes an outboard motor body 1, a bracket mechanism 2, an upper mounting apparatus 3, and a lower mounting apparatus 4.

The outboard motor body 1 includes an engine 11, an engine cover 12, a motive force transfer mechanism 13, and a casing 14. The engine 11 is disposed in an upper section of the outboard motor 100. The engine 11 includes a crank shaft 15. An axis of the crank shaft 15 extends in the up-down direction. The engine cover 12 accommodates the engine 11.

The casing 14 accommodates the motive force transfer mechanism 13. The casing 14 includes an exhaust guide 16, an upper casing 17, and a lower casing 18. The exhaust guide 16 is disposed below the engine 11. The upper casing 17 is disposed below the exhaust guide 16. The lower casing 18 is disposed below the upper casing 17.

The motive force transfer mechanism 13 transfers a motive force from the engine 11. The motive force transfer mechanism 13 includes a drive shaft 21, a propeller shaft 22, and a shift mechanism 23. The drive shaft 21 is disposed along the up-down direction. The drive shaft 21 is linked to the crank shaft 15. The propeller shaft 22 is disposed along the front-back direction. The propeller shaft 22 is linked to a lower section of the drive shaft 21 through the shift mechanism 23. The shift mechanism 23 switches the rotation direction of the motive force which is transmitted from the drive shaft 21 to the propeller shaft 22. The propeller shaft 22 is attached to the propeller 24. The propeller shaft 22 transmits the motive force to the propeller 24 from the drive shaft 21. The propeller 24 is disposed on a lower section of the outboard motor 100. The propeller 24 is rotationally driven using the motive force from the engine 11. The motive force transfer mechanism 13 transmits the motive force from the engine 11 to the propeller 24.

The bracket mechanism 2 attaches the outboard motor 100 to the boat, which is not shown. The outboard motor 100 is attachably and detachably fixed to the boat through the bracket mechanism 2. The bracket mechanism 2 includes a bracket body 25, a steering axle 26, an upper bracket 27, and a lower bracket 28. The bracket body 25 is attached to the boat so as to be able to rotate centered on a tilt axis 29. The tilt axis 29 extends in the width direction of the outboard motor 100. It is possible to change a trim angle of the outboard motor 100 by rotating the outboard motor 100 around the tilt axis 29. The steering axle 26 is rotatably supported by the bracket body 25. The steering axle 26 extends in the up-down direction of the outboard motor 100. It is possible to change the rudder angle by rotating the outboard motor 100 around the steering axle 26. An upper portion of the steering axle 26 is supported by the upper bracket 27. A lower portion of the steering axle 26 is supported by the lower bracket 28. The upper bracket 27 is attached to the outboard motor body 1 through the upper mounting apparatus 3. The lower bracket 28 is attached to the outboard motor body 1 through the lower mounting apparatus 4.

In the present preferred embodiment, a direction from the outboard motor 100 toward the boat, that is, a direction from the outboard motor body 1 to the bracket mechanism 2 is "to the front", and the opposite direction is "to the rear". In addition, the left-right direction means left-right in a state when facing to the front.

Figure 2:
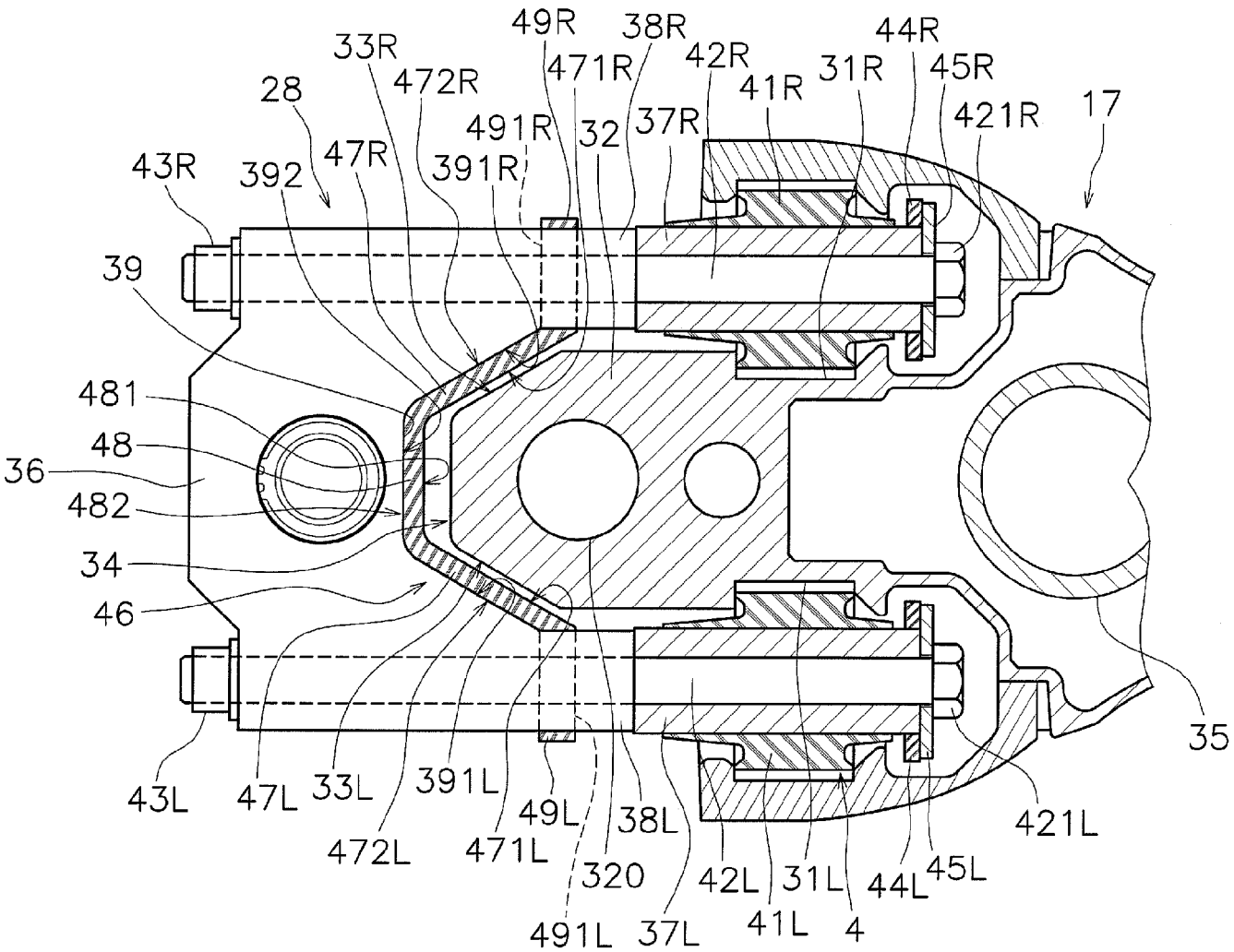
FIG. 2 is a cross-sectional diagram along a line II-II in FIG. 1.

FIG. 2 is a cross-sectional diagram along a line II-II in FIG. 1. As shown in FIG. 2, the upper casing 17 includes a left lower damper holding section 31L, a right lower damper holding section 31R, and a convex section 32. The convex section 32 is disposed between the left lower damper holding section 31L and the right lower damper holding section 31R. The convex section 32 protrudes to the front more than the left lower damper holding section 31L and the right lower damper holding section 31R. The convex section 32 includes a left first inclined surface 33L, a right first inclined surface 33R, and a first planar surface 34. The left first inclined surface 33L and the right first inclined surface 33R are inclined with respect to the front-back direction of the outboard motor body 1 in a planar view of the outboard motor body 1. The first planar surface 34 connects the left first inclined surface 33L and the right first inclined surface 33R. The first planar surface 34 is disposed parallel or substantially parallel to the width direction of the outboard motor body 1. The left first inclined surface 33L extends in a backward diagonal leftward direction from the first planar surface 34. The right first inclined surface 33R extends in a backward diagonal rightward direction from the first planar surface 34. The convex section 32 includes an opening 320 through which the drive shaft 21 passes. In addition, the upper casing 17 includes an exhaust path 35. The convex section 32 is disposed in front of the exhaust path 35. In the present preferred embodiment, "parallel" is not limited to being completely parallel, and also includes a state slightly deviated from being completely parallel, i.e., "substantially parallel". Thus, the phrase "parallel or substantially parallel" is used in this description to indicate this concept.

The lower bracket 28 includes a lower bracket body 36, a left lower tube 37L, and a right lower tube 37R. The lower bracket body 36 includes a left lower protrusion section 38L, a right lower protrusion section 38R, and a concave section 39. The left lower protrusion section 38L and the right lower protrusion section 38R protrude to the rear more than the concave section 39. The concave section 39 is disposed between the left lower protrusion section 38L and the right lower protrusion section 38R.

The lower mounting apparatus 4 includes a left first lower damper member 41L. The left first lower damper member 41L is disposed between the lower bracket 28 and the upper casing 17. The left first lower damper member 41L is held by the upper casing 17 in the left lower damper holding section 31L. The left first lower damper member 41L is preferably made of an elastic material such as rubber. The left first lower damper member 41L preferably has a cylindrical or substantially cylindrical shape. The left lower tube 37L is inserted into the left first lower damper member 41L. The left lower tube 37L and the left lower protrusion section 38L are fastened by a left lower bolt 42L and a left lower nut 43L, for example. As a result of this arrangement, the left first lower damper member 41L is fixed to the lower bracket 28.

In addition, the lower mounting apparatus 4 includes a left third lower damper member 44L. The left third lower damper member 44L is preferably made of an elastic material such as rubber. The left third lower damper member 44L is disposed on the outer circumferential side of the left lower tube 37L. A left lower washer 45L is disposed between a head section 421L of the left lower bolt 42L and the left lower tube 37L. The left third lower damper member 44L is disposed between the left lower washer 45L and the left first lower damper member 41L.

The lower mounting apparatus 4 includes a right first lower damper member 41R. The right first lower damper member 41R has a configuration which is left-right symmetrical with the left first lower damper member 41L. In addition, the right lower tube 37R and the right lower protrusion section 38R are fastened by a right lower bolt 42R and a right lower nut 43R. The right lower tube 37R and the right lower bolt 42R respectively have configurations which are left-right symmetrical with the left lower tube 37L and the left lower bolt 42L. The lower mounting apparatus 4 includes a right third lower damper member 44R. A right lower washer 45R is disposed between a head section 421R of the right lower bolt 42R and the right lower tube 37R. The right lower washer 45R and the right third lower damper member 44R respectively have configurations which are left-right symmetrical with the left lower washer 45L and the left third lower damper member 44L. Accordingly, detailed description of the configuration thereof is omitted.

Figure 3:
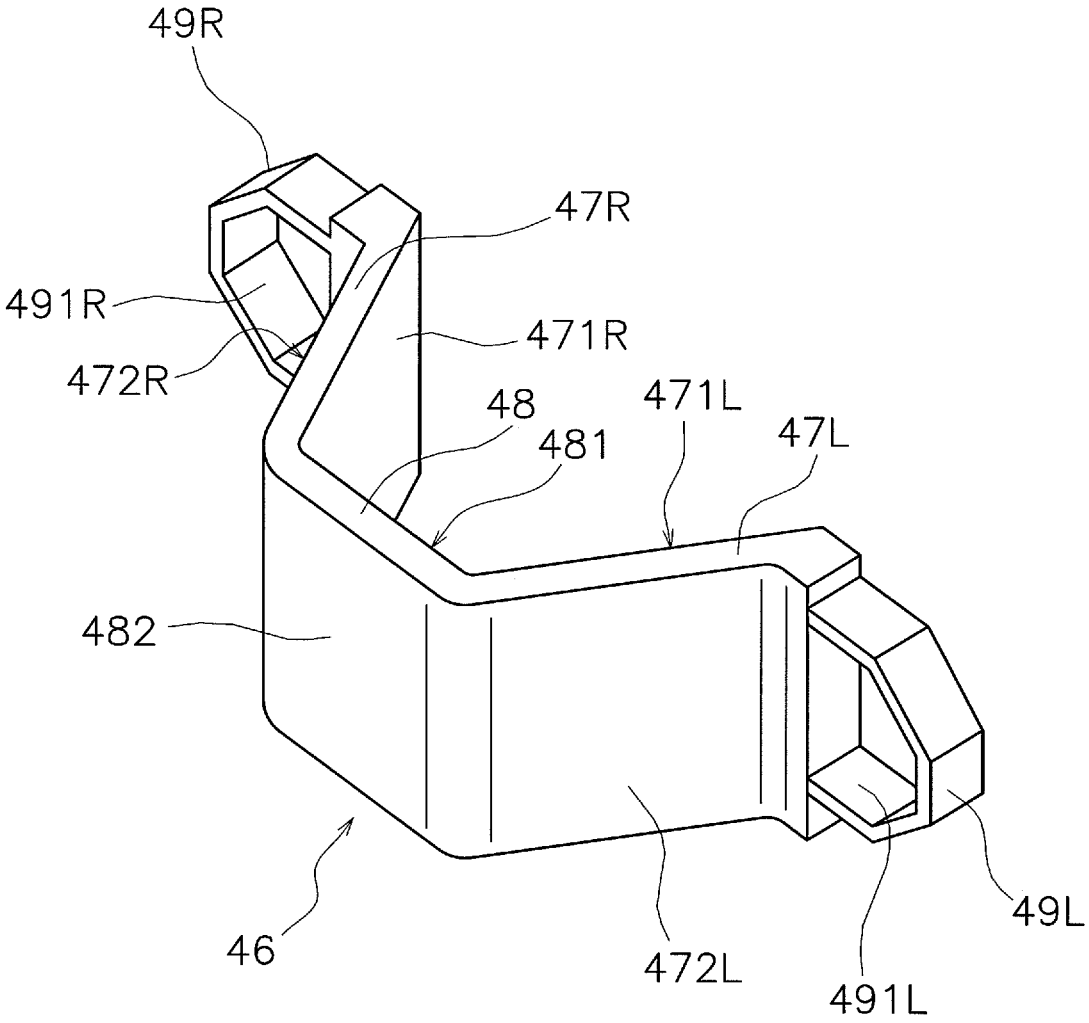
FIG. 3 is a perspective diagram of a second lower damper member.

The lower mounting apparatus 4 includes a second lower damper member 46. The second lower damper member 46 is disposed between the lower bracket 28 and the upper casing 17. The second lower damper member 46 is preferably made of an elastic material such as rubber. FIG. 3 is a perspective diagram of the second lower damper member 46. As shown in FIG. 2 and FIG. 3, the second lower damper member 46 includes a left inclined section 47L, a right inclined section 47R, and a central section 48. The central section 48 connects the left inclined section 47L and the right inclined section 47R. The left inclined section 47L, the right inclined section 47R, and the central section 48 are disposed in the concave section 39 of the lower bracket 28.

The left inclined section 47L includes a left second inclined surface 471L and a left third inclined surface 472L. The left second inclined surface 471L is arranged to oppose the left first inclined surface 33L of the upper casing 17. The left second inclined surface 471L is disposed parallel or substantially parallel to the left first inclined surface 33L. The left third inclined surface 472L is positioned on the opposite side to the left second inclined surface 471L. The left second inclined surface 471L is disposed parallel or substantially parallel with respect to the left third inclined surface 472L.

The right inclined section 47R includes a right second inclined surface 471R and a right third inclined surface 472R. The right second inclined surface 471R is arranged to oppose the right first inclined surface 33R of the upper casing 17. The right second inclined surface 471R is disposed parallel or substantially parallel to the right first inclined surface 33R. The right third inclined surface 472R is positioned on the opposite side to the right second inclined surface 471R. The right second inclined surface 471R is disposed parallel or substantially parallel with respect to the right third inclined surface 472R.

The central section 48 includes a second planar surface 481 and a third planar surface 482. The second planar surface 481 is arranged to oppose the first planar surface 34 of the upper casing 17. The second planar surface 481 connects the left second inclined surface 471L and the right second inclined surface 471R. The second planar surface 481 is disposed perpendicular or substantially perpendicular to the front-back direction. The third planar surface 482 is positioned on the opposite side to the second planar surface 481. The third planar surface 482 is disposed parallel or substantially parallel to the second planar surface 481. The third planar surface 482 connects the left third inclined surface 472L and the right third inclined surface 472R.

The concave section 39 of the lower bracket 28 includes a left fourth inclined surface 391L, a right fourth inclined surface 391R, and a fourth planar surface 392. The left fourth inclined surface 391L is arranged to oppose the left third inclined surface 472L of the second lower damper member 46 and comes into contact with the left third inclined surface 472L. The left first inclined surface 33L is parallel or substantially parallel to the left fourth inclined surface 391L. The right fourth inclined surface 391R is arranged to oppose the right third inclined surface 472R of the second lower damper member 46 and comes into contact with the right third inclined surface 472R. The right first inclined surface 33R is parallel or substantially parallel to the right fourth inclined surface 391R. The fourth planar surface 392 connects the left fourth inclined surface 391L and the right fourth inclined surface 391R. The fourth planar surface 392 is arranged to oppose the third planar surface 482 of the second lower damper member 46, and comes into contact with the third planar surface 482.

The second lower damper member 46 includes a left flange section 49L and a right flange section 49R. The left flange section 49L is disposed to the left of the left second inclined surface 471L. The left flange section 49L includes a left opening 491L. The left lower protrusion section 38L is inserted into the left opening 491L. Accordingly, the left lower bolt 42L is disposed so as to pass through the left opening 491L. The right flange section 49R is disposed to the right of the right second inclined surface 471R. The right flange section 49R includes a right opening 491R. The right lower protrusion section 38R is inserted into the right opening 491R. Accordingly, the right lower bolt 42R is disposed so as to pass through the right opening 491R.

As shown in FIG. 2, in a state in which the outboard motor body 1 does not generate a propulsion force, the convex section 32 of the upper casing 17 is separated from, i.e., spaced from, the second lower damper member 46. That is, the left first inclined surface 33L is separated from, i.e., spaced from, the left second inclined surface 471L. The right first inclined surface 33R is also separated from, i.e., spaced from, the right second inclined surface 471R. The first planar surface 34 is also separated or spaced from the second planar surface 481 of the second lower damper member 46. In this state, a distance along the front-back direction between the left first inclined surface 33L and the left second inclined surface 471L is smaller than a distance along the front-back direction between the first planar surface 34 and the central section 48 of the second lower damper member 46. A distance along the front-back direction between the right first inclined surface 33R and the right second inclined surface 471R is smaller than a distance along the front-back direction between the first planar surface 34 and the central section 48 of the second lower damper member 46.

When the boat starts to move, a load is generated in a direction in which the convex section 32 of the upper casing 17 is directed towards the lower bracket 28. At this time, in a state in which the convex section 32 of the upper casing 17 is separated from the second lower damper member 46, the left first lower damper member 41L and the right first lower damper member 41R receive a load and are compressed, but the second lower damper member 46 does not receive a load. Accordingly, during low-speed movement, the left first lower damper member 41L and the right first lower damper member 41R attenuate the vibration which is transmitted to the boat from the engine 11.

Figure 4:
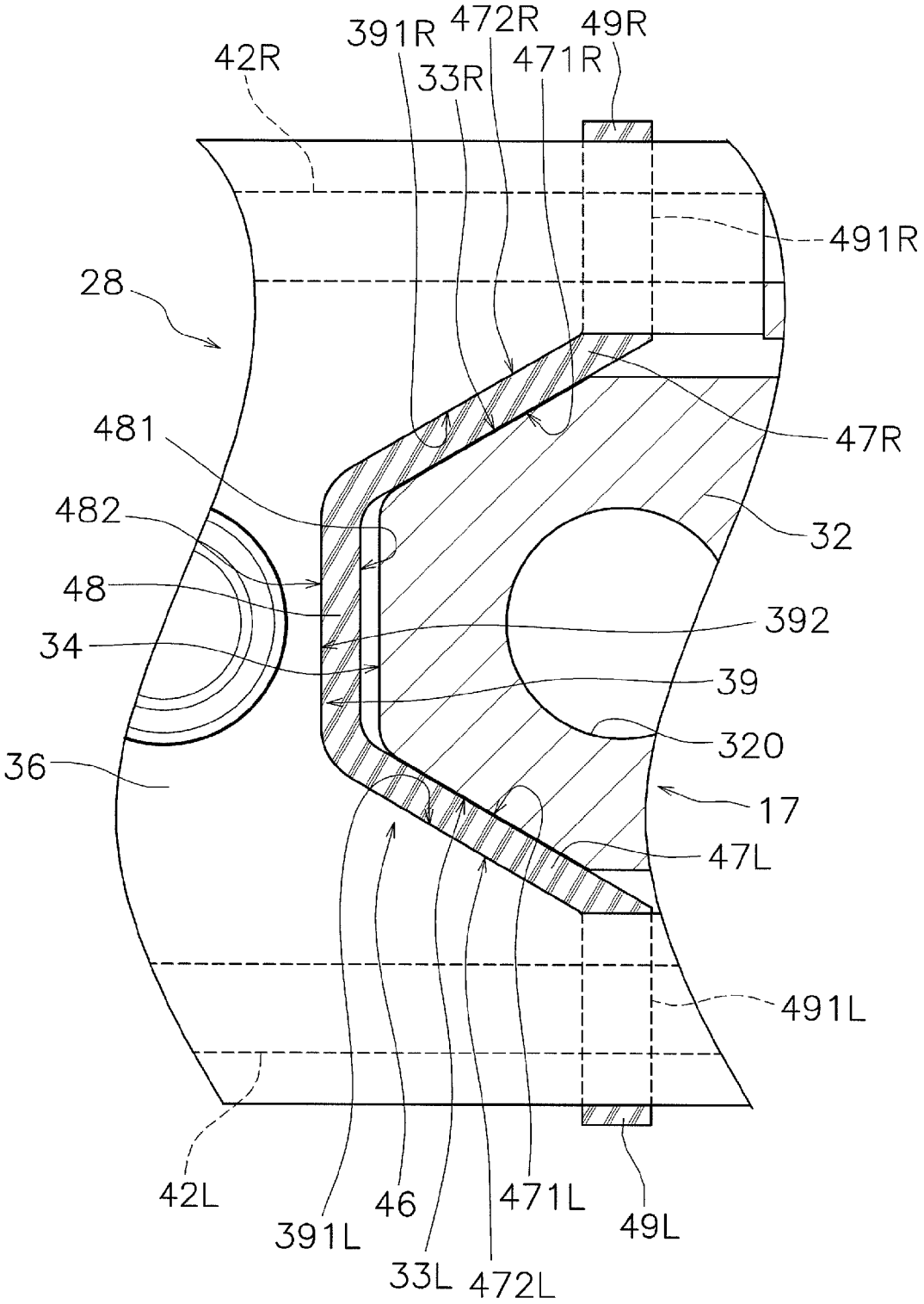
FIG. 4 is an enlarged cross-sectional diagram of a lower bracket and a lower mounting apparatus.

When the boat speed increases, the load which is received by the left first lower damper member 41L and the right first lower damper member 41R increases. As a result, as shown in FIG. 4, the convex section 32 of the upper casing 17 becomes close to the lower bracket 28, and the convex section 32 of the upper casing 17 comes into contact with the second lower damper member 46. However, the left first inclined surface 33L and the left second inclined surface 471L come into contact with each other, and the right first inclined surface 33R and the right second inclined surface 471R come into contact with each other without the first planar surface 34 and the second planar surface 481 coming into contact with each other. Accordingly, the left second inclined surface 471L and the right second inclined surface 471R of the second lower damper member 46 receive a load in the left-right direction of the outboard motor body 1. A proportion of the amount of the load in the front-back direction with respect to an amount of change in the shape in the front-back direction of the left and right first lower damper member 41L and 41R is smaller than a proportion of the amount of the load in the front-back direction with respect to the amount of change in the shape in the front-back direction of the second lower damper member 46. That is, if the amount of the load is the same, the amount of change in the shape of the second lower damper member 46 is smaller than the amount of change in the shape of the left and right first lower damper member 41L and 41R. Accordingly, it is possible to minimize a decrease in the control stability during high-speed movement due to the left second inclined surface 471L and the right second inclined surface 471R of the second lower damper member 46 receiving the load. In addition, it is possible to effectively attenuate vibration which is transmitted to the boat from the engine 11 during low-speed movement since the left first lower damper member 41L and the right first lower damper member 41R, which are highly flexible, receive the load.

Figure 5:
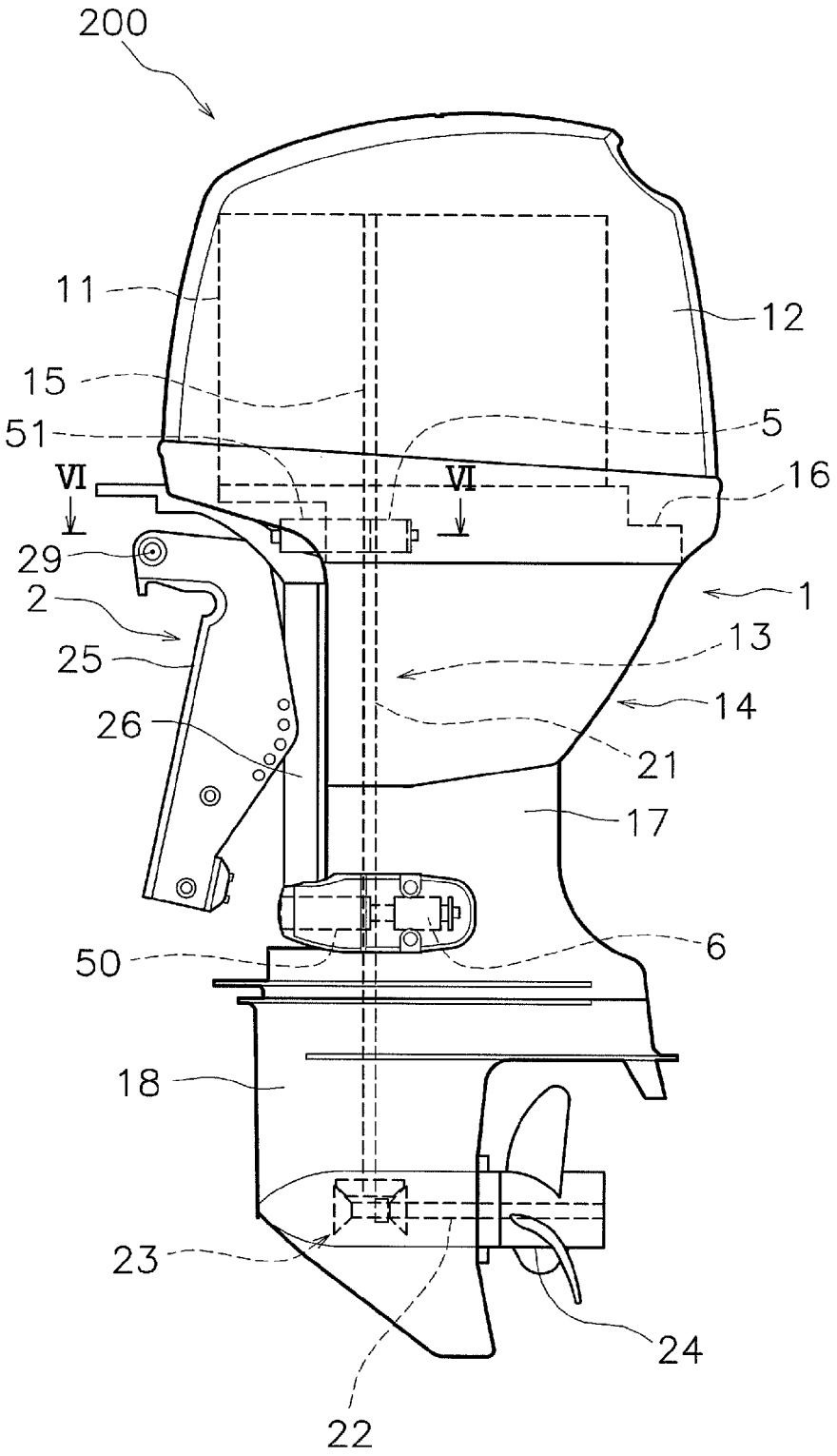
FIG. 5 is a side view diagram of an outboard motor according to a second preferred embodiment of the present invention.

Next, an outboard motor 200 according to a second preferred embodiment of the present invention will be described. FIG. 5 is a side view diagram of the outboard motor 200 according to the second preferred embodiment of the present invention. The configuration of the outboard motor 200 according to the second preferred embodiment preferably is the same or substantially the same as the configuration of the outboard motor 100 according to the first preferred embodiment. Accordingly, the outboard motor 200 according to the second preferred embodiment shown in FIG. 5 preferably has the same or substantially the same configuration as the outboard motor 100 according to the first preferred embodiment, and the same elements are indicated with the same reference numerals. The outboard motor 200 according to the second preferred embodiment includes an upper bracket 51, a lower bracket 50, an upper mounting apparatus 5, and a lower mounting apparatus 6.

Figure 6:
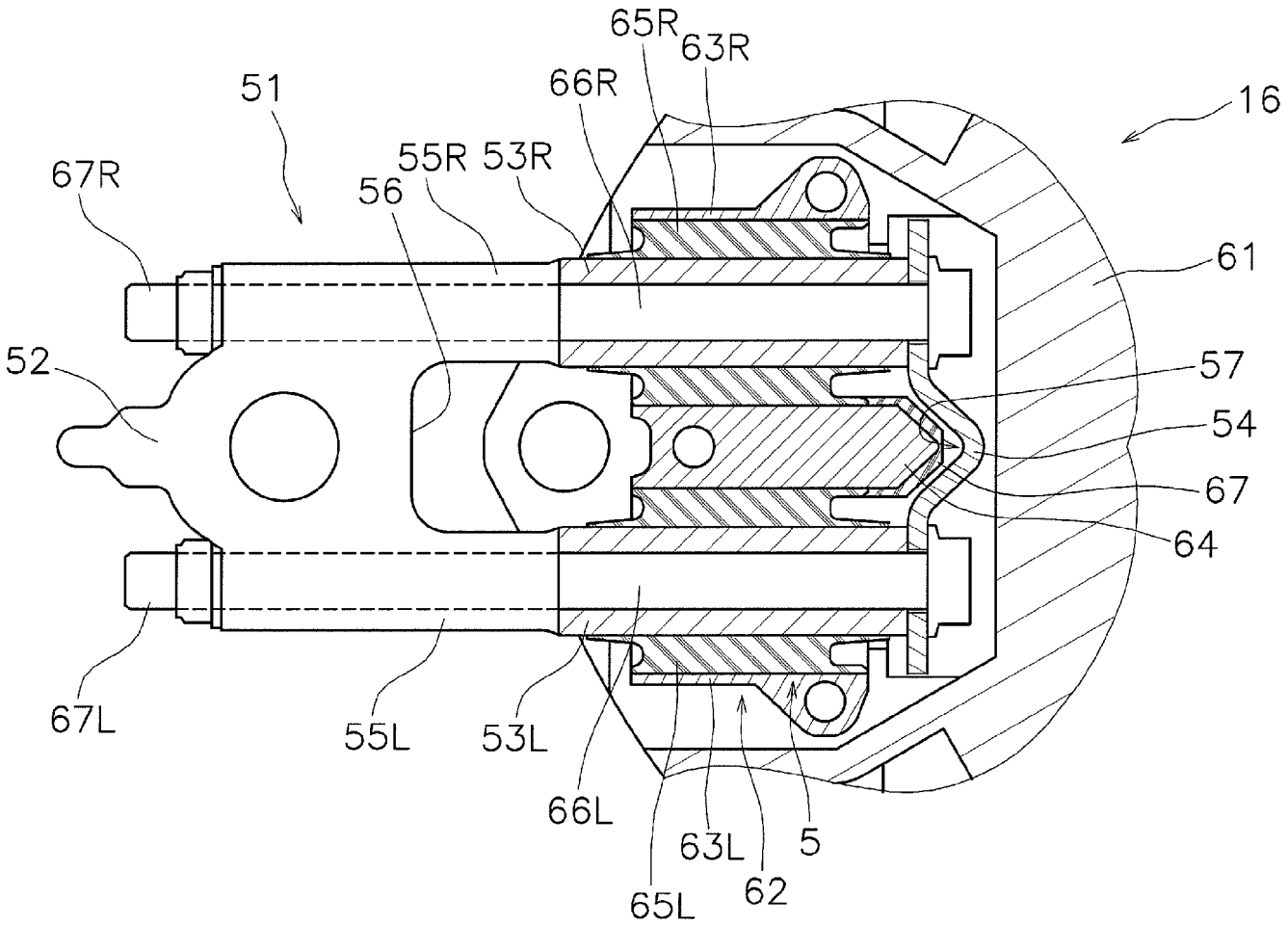
FIG. 6 is a cross-sectional diagram along a line VI-VI in FIG. 5.

FIG. 6 is a cross-sectional diagram along a line VI-VI in FIG. 5. As shown in FIG. 6, the upper bracket 51 includes an upper bracket body 52, a left upper tube 53L, a right upper tube 53R, and an inner bracket 54. The upper bracket body 52 includes a left upper protrusion section 55L, a right upper protrusion section 55R, and a concave section 56. The left upper protrusion section 55L and the right upper protrusion section 55R protrude to the rear more than the concave section 56. The concave section 56 is disposed between the left upper protrusion section 55L and the right upper protrusion section 55R. The inner bracket 54 is linked to the left upper tube 53L and the right upper tube 53R.

Figure 7:
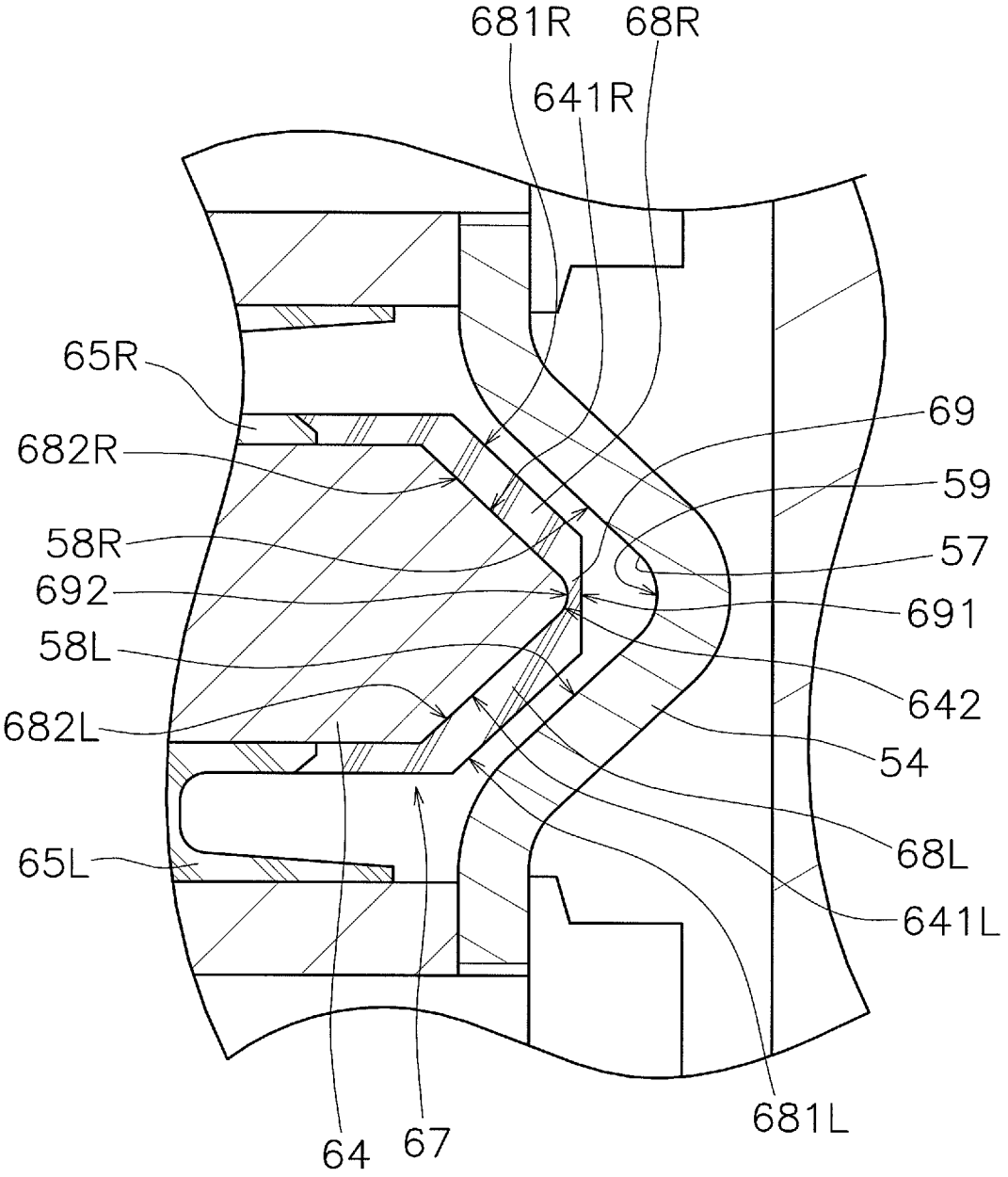
FIG. 7 is an enlarged cross-sectional diagram of an upper bracket and an upper mounting apparatus.

The inner bracket 54 includes a concave section 57. FIG. 7 is an enlarged cross-sectional diagram of the upper mounting apparatus 5 and the upper bracket 51. The concave section 57 includes a left first inclined surface 58L, a right first inclined surface 58R, and a first planar surface 59. The left first inclined surface 58L and the right first inclined surface 58R are inclined with respect to the front-back direction of the outboard motor body 1 in a planar view of the outboard motor body 1. The first planar surface 59 connects the left first inclined surface 58L and the right first inclined surface 58R. The first planar surface 59 is parallel or substantially parallel to the width direction of the outboard motor body 1. The left first inclined surface 58L extends in a forward diagonal leftward direction from the first planar surface 59. The right first inclined surface 58R extends in a forward diagonal rightward direction from the first planar surface 59.

As shown in FIG. 6, the exhaust guide 16 includes an exhaust guide body 61 and an upper mounting attachment section 62. The exhaust guide body 61 supports the engine 11. The upper mounting attachment section 62 is attached to the exhaust guide body 61. The upper mounting attachment section 62 includes a left upper damper holding section 63L, a right upper damper holding section 63R, and a convex section 64. The convex section 64 is disposed between the left upper damper holding section 63L and the right upper damper holding section 63R. The convex section 64 protrudes more to the rear than the left upper damper holding section 63L and the right upper damper holding section 63R.

The upper mounting apparatus 5 includes a left first upper damper member 65L and a right first upper damper member 65R. The left first upper damper member 65L is disposed between the upper bracket 51 and the exhaust guide 16. The left first upper damper member 65L is held by the exhaust guide 16 in the left upper damper holding section 63L. The left first upper damper member 65L preferably is made of an elastic material such as rubber. The left first upper damper member 65L has a cylindrical or substantially cylindrical shape. The left upper tube 53L is inserted into the left first upper damper member 65L. The left upper tube 53L, the left lower protrusion section 38L, and the inner bracket 54 are fastened by a left upper bolt 66L and a left upper nut 67L, for example. As a result of this arrangement, the left first upper damper member 65L is fixed to the upper bracket 51.

The right upper tube 53R, the right upper protrusion section 55R, and the inner bracket 54 are fastened by a right upper bolt 66R and a right upper nut 67R, for example. The right first upper damper member 65R, the right upper tube 53R, and the right upper bolt 66R respectively have a configuration which is left-right symmetrical with the left first upper damper member 65L, the left upper tube 53L, and the left upper bolt 66L. Accordingly, detailed description of this configuration is omitted.

The upper mounting apparatus 5 includes a second upper damper member 67. The second upper damper member 67 is disposed between the upper bracket 51 and the exhaust guide 16. The second upper damper member 67 preferably is made of an elastic material such as rubber. The second upper damper member 67 is integrated with the left first upper damper member 65L and the right first upper damper member 65R. However, the second upper damper member 67 may also be separated from the left first upper damper member 65L and the right first upper damper member 65R. As shown in FIG. 7, the second upper damper member 67 includes a left inclined section 68L, a right inclined section 68R, and a central section 69. The central section 69 connects the left inclined section 68L and the right inclined section 68R.

The left inclined section 68L includes a left second inclined surface 681L and a left third inclined surface 682L. The left second inclined surface 681L is arranged to oppose the left first inclined surface 58L of the inner bracket 54. The left second inclined surface 681L is parallel or substantially parallel to the left first inclined surface 58L. The left third inclined surface 682L is positioned on the opposite side to the left second inclined surface 681L. The left second inclined surface 681L is parallel or substantially parallel to the left third inclined surface 682L.

The right inclined section 68R includes a right second inclined surface 681R and a right third inclined surface 682R. The right second inclined surface 681R is arranged to oppose the right first inclined surface 58R of the inner bracket 54. The right second inclined surface 681R is parallel or substantially parallel to the right first inclined surface 58R. The right third inclined surface 682R is positioned on the opposite side to the right second inclined surface 681R. The right second inclined surface 681R is parallel or substantially parallel to the right third inclined surface 682R.

The central section 69 includes a second planar surface 691 and a third planar surface 692. The second planar surface 691 is arranged to oppose the first planar surface 59 of the inner bracket 54. The second planar surface 691 connects the left second inclined surface 681L and the right second inclined surface 681R. The second planar surface 691 is perpendicular or substantially perpendicular to the front-back direction. The third planar surface 692 is positioned on the opposite side to the second planar surface 691. The third planar surface 692 connects the left third inclined surface 682L and the right third inclined surface 682R.

The convex section 64 of the upper mounting attachment section 62 includes a left fourth inclined surface 641L, a right fourth inclined surface 641R, and a fourth planar surface 642. The left fourth inclined surface 641L is arranged to oppose the left third inclined surface 682L of the second upper damper member 67 and comes into contact with the left third inclined surface 682L. The left first inclined surface 58L is parallel or substantially parallel to the left fourth inclined surface 641L. The right fourth inclined surface 641R is arranged to oppose the right third inclined surface 682R of the second upper damper member 67 and comes into contact with the right third inclined surface 682R. The right first inclined surface 58R is parallel or substantially parallel to the right fourth inclined surface 641R. The fourth planar surface 642 connects the left fourth inclined surface 641L and the right fourth inclined surface 641R. The fourth planar surface 642 is arranged to oppose the third planar surface 692 of the second upper damper member 67 and comes into contact with the third planar surface 692.

As shown in FIG. 6 and FIG. 7, the concave section 57 of the inner bracket 54 is separated from the second upper damper member 67 in a state in which the outboard motor body 1 does not generate a propulsion force. That is, the left first inclined surface 58L is separated from the left second inclined surface 681L. The right first inclined surface 58R is also separated from the right second inclined surface 681R. The first planar surface 59 is also separated from the second planar surface 691 of the second upper damper member 67. In this state, a distance along the front-back direction between the left first inclined surface 58L and the left second inclined surface 681L is smaller than a distance along the front-back direction between the first planar surface 59 and the central section 69 of the second upper damper member 67. A distance along the front-back direction between the right first inclined surface 58R and the right second inclined surface 681R is smaller than a distance along the front-back direction between the first planar surface 59 and the central section 69 of the second upper damper member 67.

When the boat starts to move, a load is generated in a direction in which the convex section 64 of the upper mounting 62 is directed towards the inner bracket 54. At this time, in a state in which the concave section 57 of the inner bracket 54 is separated from the second lower damper member 67, the left first upper damper member 65L and the right first upper damper member 65R receive a load and are compressed, but the second upper damper member 67 does not receive the load. Accordingly, during low-speed movement, the left first upper damper member 65L and the right first upper damper member 65R attenuate the vibration which is transmitted to the boat from the engine 11.

Figure 8:
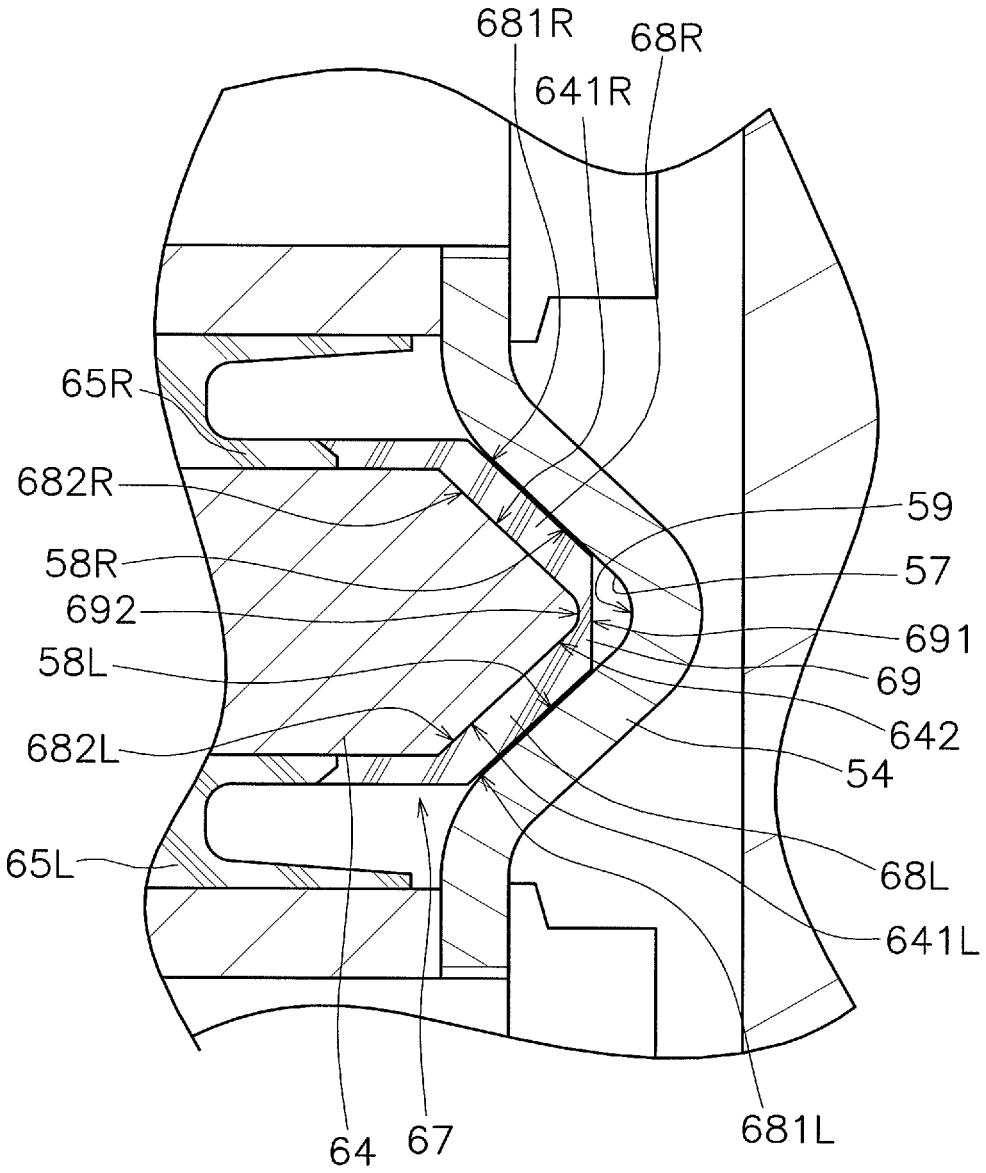
FIG. 8 is an enlarged cross-sectional diagram of an upper bracket and an upper mounting apparatus.

When the boat speed increases, the load which is received by the left first upper damper member 65L and the right first upper damper member 65R increases. As a result of this arrangement, as shown in FIG. 8, the convex section 64 of the upper mounting attachment section 62 becomes close to the concave section 57 of the inner bracket 54, and the second upper damper member 67 comes into contact with the concave section 57 of the inner bracket 54. However, the left first inclined surface 58L and the left second inclined surface 681L come into contact with each other and the right first inclined surface 58R and the right second inclined surface 681R come into contact with each other without the first planar surface 59 and the second planar surface 691 coming into contact with each other. Accordingly, the left second inclined surface 681L and the right second inclined surface 681R of the second upper damper member 67 receive a load in the left-right direction of the outboard motor body 1. A proportion of the amount of the load in the front-back direction with respect to an amount of change in the shape in the front-back direction of the left and right first upper damper members 65L and 65R is smaller than a proportion of the amount of the load in the front-back direction with respect to an amount of change in the shape in the front-back direction of the second upper damper member 67. That is, if the amount of the load is the same, the amount of change in the shape in the second upper damper member 67 is smaller than the amount of change in the shape in the left and right first upper damper members 65L and 65R. Accordingly, it is possible to minimize a decrease in the control stability during high-speed movement due to the left second inclined surface 681L and the right second inclined surface 681R of the second upper damper member 67 receiving the load. In addition, it is possible to effectively attenuate vibration which is transmitted to the boat from the engine 11 during low-speed movement since the left first upper damper member 65L and the right first upper damper member 65R, which are highly flexible, receive the load.

Preferred embodiments of the present invention were described above, but the present invention is not limited to the preferred embodiments described above and various changes are possible within a scope that does not depart from the gist of the present invention.

In the outboard motor 100 according to the first preferred embodiment described above, a known upper bracket and a known upper mounting apparatus may be provided as the upper bracket 27 and the upper mounting apparatus 3. In the outboard motor 200 according to the second preferred embodiment described above, a known lower bracket and a known lower mounting apparatus may be provided as the lower bracket 50 and the lower mounting apparatus 6. Alternatively, the lower bracket 28 and the lower mounting apparatus 4 of the first preferred embodiment described above and the upper bracket 51 and the upper mounting apparatus 5 of the second preferred embodiment described above may be provided together in the outboard motor.

Figure 9:
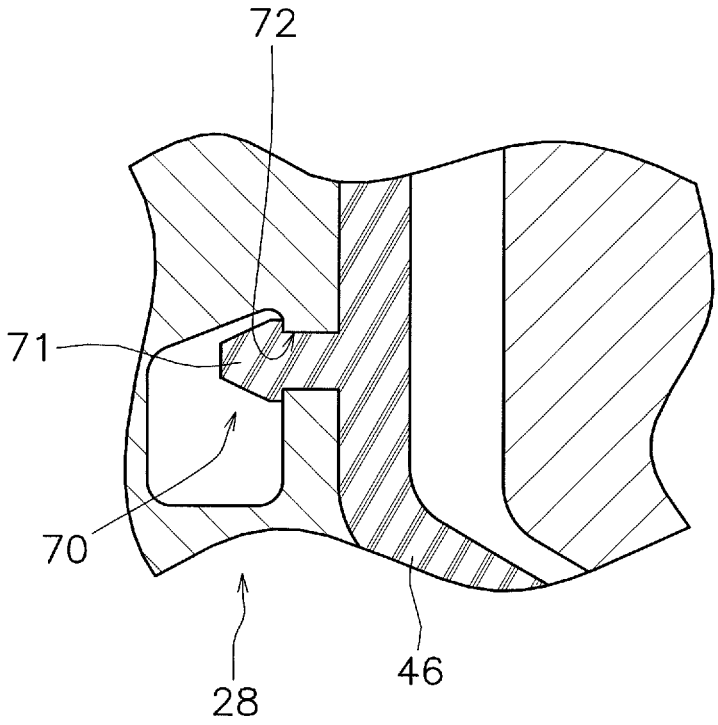
FIG. 9 is a diagram illustrating a fixed configuration of a second lower damper member and a lower bracket according to another preferred embodiment of the present invention.

In the outboard motor 100 according to the first preferred embodiment, the second lower damper member 46 may be bonded to the lower bracket 28. Alternatively, the second lower damper member 46 may be attached to the lower bracket 28 by a fixed configuration 70 as shown in FIG. 9. The fixed configuration 70 includes a protuberance 71 which is provided in the second lower damper member 46 and a hole 72 which is provided in the lower bracket 28. The second lower damper member 46 is attached to the lower bracket 28 by inserting the protuberance 71 into the hole 72 to engage with an edge of the hole 72. In this case, it is easy to exchange the second lower damper member 46 since the second lower damper member 46 is attachable and detachable with respect to the lower bracket 28. In the same manner, in the outboard motor 200 according to the second preferred embodiment, the second upper damper member 67 may be bonded to the upper mounting attachment section 62 of the exhaust guide 16. Alternatively, in the outboard motor 200 according to the second preferred embodiment, the second upper damper member 67 may be attached to the upper mounting attachment section 62 by a fixed configuration which is the same as the fixed configuration 70 described above.

Figure 10:
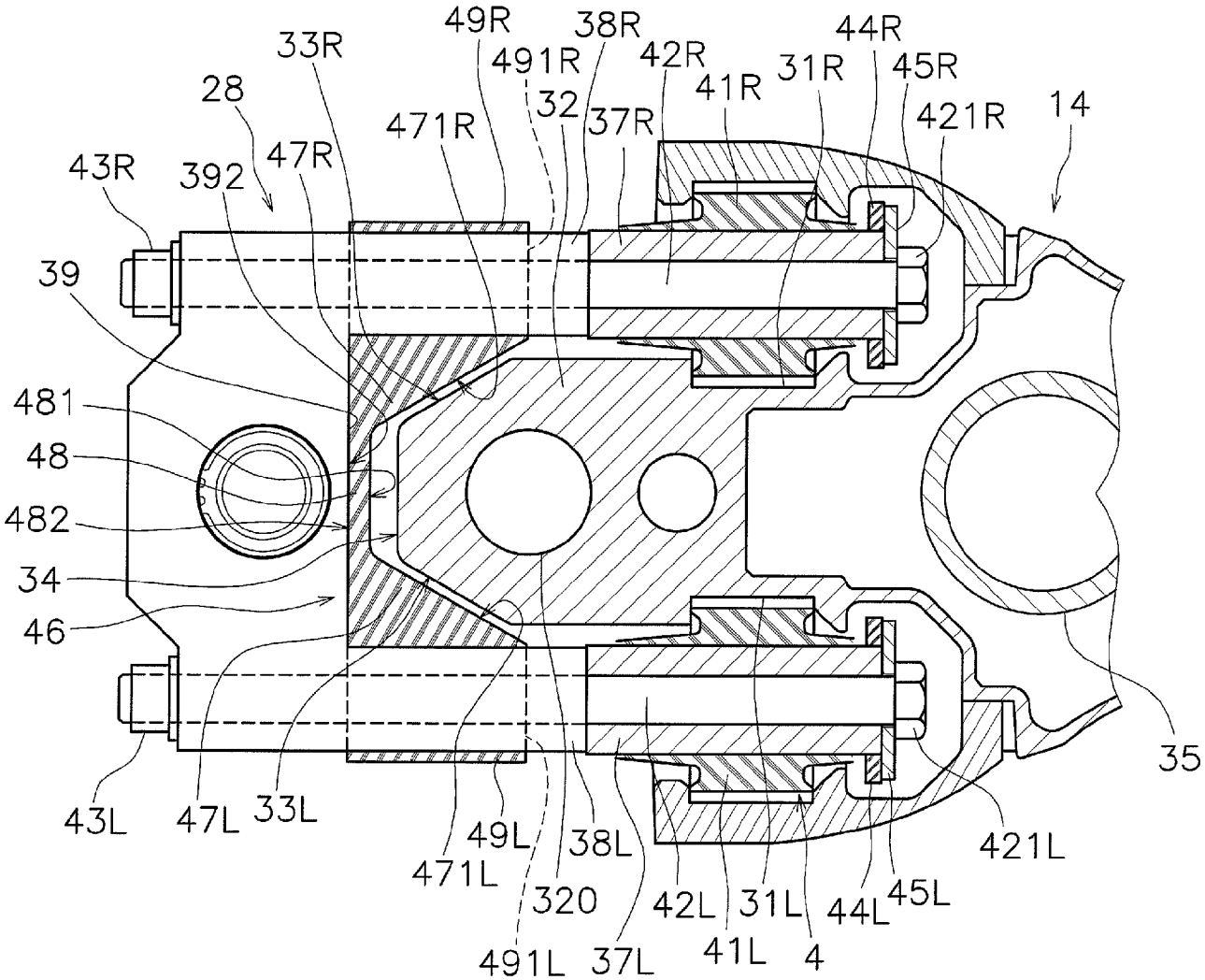
FIG. 10 is an enlarged cross-sectional diagram of a lower bracket and a lower mounting apparatus according to another preferred embodiment of the present invention.

The configuration of the lower bracket 28 and the lower mounting apparatus 4 is not limited to the configuration of the first preferred embodiment described above. For example, as shown in FIG. 10, the left third inclined surface 472L and the right third inclined surface 472R need not be provided in the second lower damper member 46. In this case, the left fourth inclined surface 391L and the right fourth inclined surface 391R need not be provided in the lower bracket 28.

Figure 11:
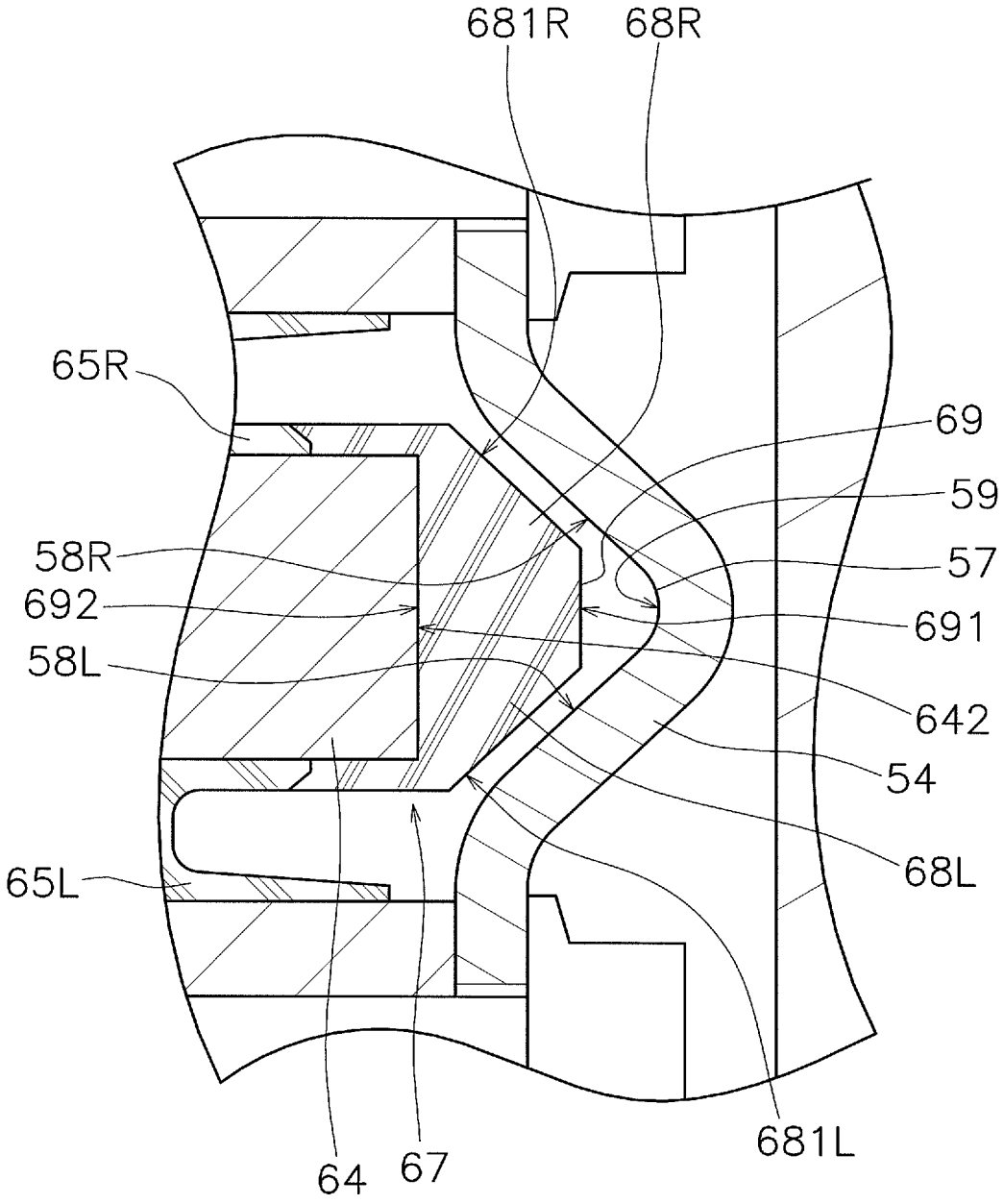
FIG. 11 is an enlarged cross-sectional diagram of an upper bracket and an upper mounting apparatus according to another preferred embodiment of the present invention.

The configuration of the upper bracket 51 and the upper mounting apparatus 5 is not limited to the configuration of the second preferred embodiment described above. For example, as shown in FIG. 11, the left third inclined surface 682L and the right third inclined surface 682R need not be provided in the second upper damper member 67. In this case, the left fourth inclined surface 641L and the right fourth inclined surface 641R need not be provided in the upper bracket 51.

In the first preferred embodiment, there may be a configuration such that the second lower damper member 46 comes into contact with the casing 14 and a gap is provided between the second lower damper member 46 and the lower bracket 28. In the second preferred embodiment, there may be a configuration such that the second upper damper member 67 comes into contact with the upper bracket 51 and a gap is provided between the second upper damper member 67 and the casing 14.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor body including an engine, an engine cover which accommodates the engine, a drive shaft disposed below the engine cover and arranged to transmit a motive force to a propeller, and a casing which accommodates the drive shaft;

a bracket attached to the casing;

a steering axle supported by the bracket;

a first damper member disposed between the bracket and the casing, the first damper member supporting a weight of the outboard motor body; and a second damper member disposed between the bracket and the casing; wherein the casing or the bracket includes a left first inclined surface and a right first inclined surface which are inclined with respect to a front-back direction of the outboard motor body in a planar view of the outboard motor body; and the second damper member includes a left second inclined surface arranged to oppose the left first inclined surface, and a right second inclined surface arranged to oppose the right first inclined surface.

2. The outboard motor according to claim 1, wherein the left first inclined surface is spaced from the left second inclined surface and the right first inclined surface is spaced from the right second inclined surface in a state in which the outboard motor body is not generating a propulsion force.

3. The outboard motor according to claim 2, wherein the left first inclined surface is parallel or substantially parallel to the left second inclined surface; and the right first inclined surface is parallel or substantially parallel to the right second inclined surface.

4. The outboard motor according to claim 1, wherein the second damper member further includes a central section arranged to connect the left second inclined surface and the right second inclined surface.

5. The outboard motor according to claim 4, wherein the central section includes a surface which is perpendicular or substantially perpendicular to the front-back direction.

6. The outboard motor according to claim 4, wherein the casing or the bracket further includes a first planar surface arranged to connect the left first inclined surface and the right first inclined surface; and the first planar surface is arranged to oppose the central section of the second damper member.

7. The outboard motor according to claim 6, wherein the left first inclined surface is spaced from the left second inclined surface, the right first inclined surface is spaced from the right second inclined surface, and the first planar surface is spaced from the central section of the second damper member in a state in which the outboard motor body is not generating a propulsion force;

a distance along the front-back direction between the left first inclined surface and the left second inclined surface is smaller than a distance along the front-back direction between the first planar surface and the central section of the second damper member; and a distance along the front-back direction between the right first inclined surface and the right second inclined surface is smaller than a distance along the front-back direction between the first planar surface and the central section of the second damper member.

8. The outboard motor according to claim 7, wherein the left first inclined surface is parallel or substantially parallel to the left second inclined surface; and the right first inclined surface is parallel or substantially parallel to the right second inclined surface.

9. The outboard motor according to claim 6, wherein the casing includes a convex section including the left first inclined surface, the right first inclined surface, and the first planar surface; and the convex section includes an opening through which the drive shaft passes.

10. The outboard motor according to claim 1, wherein a proportion of an amount of a load in the front-back direction with respect to an amount of change in a shape of the first damper member in the front-back direction is smaller than a proportion of an amount of a load in the front-back direction with respect to an amount of change in a shape of the second damper member in the front-back direction.

11. The outboard motor according to claim 1, further comprising:

a left bolt to fix a left first damper member to the bracket; and a right bolt to fix a right first damper member to the bracket; wherein the first damper member includes the left first damper member and the right first damper member;

the second damper member further includes a left flange section disposed to a left of the left second inclined surface and a right flange section disposed to a right of the right second inclined surface;

the left flange section includes a left opening through which the left bolt passes; and the right flange section includes a right opening through which the right bolt passes.

12. The outboard motor according to claim 1, wherein the bracket supports a lower portion of the steering axle; and the casing includes the left first inclined surface and the right first inclined surface.

13. The outboard motor according to claim 12, wherein the second damper member further includes a left third inclined surface positioned on an opposite side to the left second inclined surface, and a right third inclined surface positioned on an opposite side to the right second inclined surface; and the bracket further includes a left fourth inclined surface arranged to oppose the left third inclined surface, and a right fourth inclined surface arranged to oppose the right third inclined surface.

14. The outboard motor according to claim 13, wherein the left second inclined surface is parallel or substantially parallel to the left third inclined surface; and the right second inclined surface is parallel or substantially parallel to the right third inclined surface.

15. The outboard motor according to claim 13, wherein the left first inclined surface is parallel or substantially parallel to the left fourth inclined surface; and the right first inclined surface is parallel or substantially parallel to the right fourth inclined surface.

16. The outboard motor according to claim 1, wherein the bracket supports an upper portion of the steering axle; and the bracket includes the left first inclined surface and the right first inclined surface.

17. The outboard motor according to claim 16, wherein the second damper member further includes a left third inclined surface positioned on an opposite side to the left second inclined surface, and a right third inclined surface positioned on an opposite side to the right second inclined surface; and the casing further includes a left fourth inclined surface arranged to oppose the left third inclined surface, and a right fourth inclined surface arranged to oppose the right third inclined surface.

18. The outboard motor according to claim 17, wherein the left second inclined surface is parallel or substantially parallel to the left third inclined surface; and the right second inclined surface is parallel or substantially parallel to the right third inclined surface.

19. The outboard motor according to claim 17, wherein the left first inclined surface is parallel or substantially parallel to the left fourth inclined surface; and the right first inclined surface is parallel or substantially parallel to the right fourth inclined surface.

* * * * *